United States Patent [19]

Gale

[11] Patent Number: 4,920,939

[45] Date of Patent: May 1, 1990

[54] POSITION SENSOR MONITORING SYSTEM

[75] Inventor: Allan R. Gale, Allen Park, Mich.

[73] Assignee: Ford Motor Company, Dearborn, Mich.

[21] Appl. No.: 316,191

[22] Filed: Feb. 27, 1989

[51] Int. Cl.[5] ..... F02D 11/10; F02B 77/08

[52] U.S. Cl. ..... 123/399; 123/479; 324/549; 340/438

[58] Field of Search ..... 123/361, 399, 479; 73/118.1; 324/208, 549; 364/431.11; 340/870.38, 438, 459

[56] References Cited

U.S. PATENT DOCUMENTS

| | | | |
|---|---|---|---|
| 4,541,386 | 9/1985 | Kishi et al. | 123/479 |
| 4,566,418 | 1/1986 | Yamamoto et al. | 123/479 |
| 4,587,615 | 5/1986 | Takahashi | 123/479 |
| 4,589,401 | 5/1986 | Karim et al. | 123/479 |
| 4,640,248 | 2/1987 | Stoltman | 123/399 |

FOREIGN PATENT DOCUMENTS 59-58124 4/1984 Japan .

*Primary Examiner*—Tony M. Argenbright

*Attorney, Agent, or Firm*—Allan J. Lippa; Peter Abolins

[57] ABSTRACT

A condition monitoring system for a position sensor coupled to a control device in a throttle control system. The position sensor includes a potentiometer having a main resistor coupled across a source of electrical power and a wiper arm mechanically coupled to the control device and electrically coupled to the main resistor. An electrical signal is developed on the wiper arm which is directly proportional to the actual position of the control device. A sensing or monitoring resistor is connected in series between the main resistor and source of electrical power for providing a current measurement directly correlated with actual resistance of the main resistor. The voltage drop across the sense resistor is compared to a predetermined range for providing an indication of main resistor operation independently of wiper arm position.

21 Claims, 3 Drawing Sheets

POSITION SENSOR MONITORING SYSTEM

BACKGROUND OF THE INVENTION

The field of the invention relates to fault detection for mechanical-electrical position sensors.

In motor vehicle applications in particular, throttle control systems utilize position sensors for providing an electrical signal related to the position, or throttle angle, of the engine throttle plate. Examples of such control systems include, speed control systems, wheelslip control systems, and drive-by-wire control systems. In a typical drive-by-wire control systems, an error signal is derived by comparing a desired throttle angle signal to an actual throttle angle signal from the throttle position sensor. A servo motor adjust the engine throttle in response to the error signal. In some drive-by-wire systems, the desired throttle angle signal is provided by another position sensor coupled to an actuator such as the vehicle accelerator pedal. If either position sensor is faulty, undesired engine operation may result.

The position sensors are defined by a potentiometer having a main resistor coupled across a source of electrical power and a wiper arm mechanically coupled to the control device (throttle plate or accelerator pedal) and electrically coupled to the main resistor. Thus, a conventional resistive voltage divider network is formed wherein the voltage at the wiper arm is proportional to position of the control device.

A conventional fault detection scheme for a potentiometer sensor is disclosed in Japanese patent reference No. 59-58124 issued to Mitsuhiko. The wiper arm of the potentiometer is coupled to an operational amplifier configured as a voltage comparator. A fault indication is provided when the sensor output either exceeds a voltage associated with the throttle open position or falls below a voltage associated with the throttle closed position. In response to the fault indication, a fault indicator lamp is actuated.

The inventor herein has recognized numerous disadvantages with the prior fault detection approaches. Since output voltage at the wiper arm is compared, and this voltage varies with position of the control device, these approaches are limited to detecting faults which occur beyond the voltage range associated with the operating range of the control device. Stated another way, prior approaches are limited to detecting catastrophic failures such as shorts or opens in the main resistor. For example, if the main resistor is partially shorted to ground, prior approaches will only detect a fault when the throttle moves to near a throttle closed position. During normal vehicle driving, a fault indication may not be provided even though the throttle control system is behaving erratically. Similarly, if the main resistor is partially shorted to the voltage source, prior approaches will only detect a fault when the throttle moves near a throttle open position. Further, prior approaches may not detect partial impairment of the main resistor which may result in erratic control system behavior.

SUMMARY OF THE INVENTION

It is an object of the invention claimed herein to provide an indication of the operating condition of a position sensor in a throttle control system regardless of the position of the control device.

The above and other problems and disadvantages are overcome, and object achieved, by providing an operating condition monitoring apparatus for a position sensor coupled to a control device in a throttle control system. In one particular aspect of the invention, the apparatus comprises: a potentiometer utilized as a position sensor for providing the throttle control system with an electrical signal related to position of the control device, the potentiometer includes a main resistor coupled across a source of electrical power and a wiper arm responsive to position of the control device and electrically coupled to the main resistor for providing the electrical signal; sensing means for sensing current flow through the main resistor thereby providing a measurement directly correlated with actual resistance of the main resistor independently of wiper arm position, the sensing means comprising a sense resistor connected in series between the main resistor and the source of electrical power; and comparison means for comparing a voltage drop across the sense resistor to a predetermined range to provide an indication of operation of the main resistor independently of wiper arm position.

By providing a measurement directly correlated with actual resistance of the main resistor independently of wiper arm position, an advantage is obtained of providing an accurate indication of the operating condition of the main resistor and accordingly position sensor. Thus, a relatively small degradation (any degradation beyond manufacturing specifications) is detected whereas prior approaches were limited to detecting catastrophic failures of the position sensor.

BRIEF DESCRIPTION OF THE DRAWINGS

The object and advantages may be better understood by reading the following Description of the Preferred Embodiment with reference to the following drawings wherein.

DESCRIPTION OF THE PREFERRED EMBODIMENT

An example of an embodiment which utilizes the invention to advantage is now described. The example is referred to herein as the Preferred Embodiment.

Figure 1:
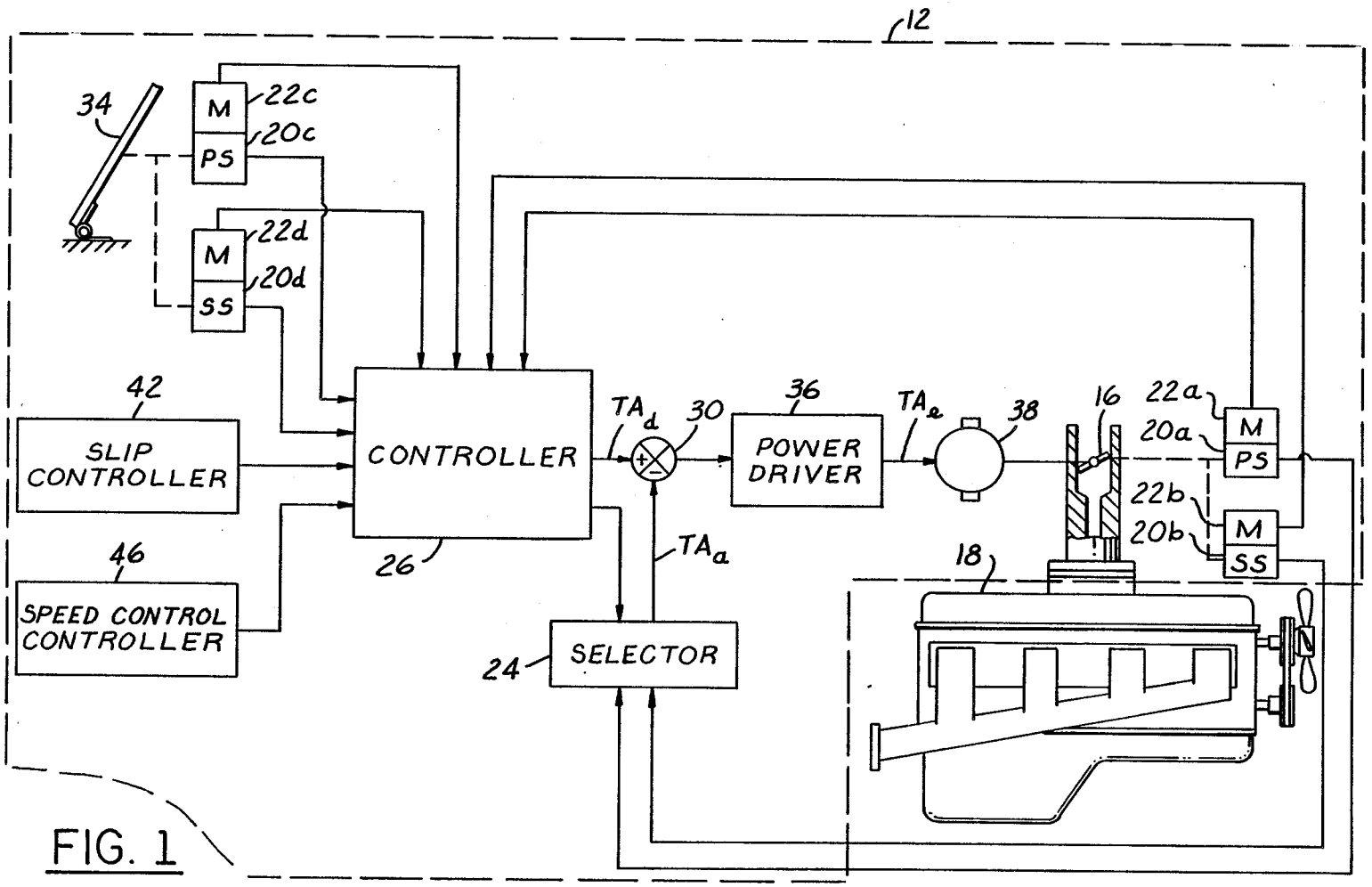
FIG. 1 is a block diagram of a throttle control system in which the invention is used to advantage.

Referring first to FIG. 1, a block diagram of throttle control system 12 is shown for use in either a drive-by-wire, or speed control system, or wheelslip control system such as disclosed in U.S. Pat. No. 4,768,608 issued to Hrovat on Sept. 6, 1988 and assigned to Ford Motor Company, the specification of which is herein incorporated by reference. In general terms, throttle plate 16 of engine 18 is shown coupled to primary position sensor **20*a* and secondary position sensor 20*b*. Each position sensor provides a signal having a voltage amplitude directly related to position or angle of throttle plate 16. In this particular example, the outputs of both sensors 20*a* and 20*b* are shown coupled to selector 24**.

As described in greater detail hereinafter, monitor **22*a* is shown coupled to position sensor 20*a* for providing information to microcontroller 26 regarding the operating condition of position sensor 20*a***. Similarly, monitor 22*b* is shown providing information to microcontroller 26 regarding the operating condition of position sensor 20*b*. Dependent upon the operating condition of sensors 20*a* and 20*b*, microcontroller 26 instructs selector 24 to couple the most reliable sensor to summer 30. Thus, summer 30 is provided with the most accurate signal related to actual throttle position ($TA_a$).

An operator actuating device, here shown as accelerator pedal 34, is coupled to both primary sensor 20*c* and secondary sensor 20*d* which each provide a signal to microcontroller 26 having a voltage amplitude directly related to the position of accelerator pedal 34 and, accordingly, the throttle position desired by the operator. Monitors 22*c* and 22*d* are shown coupled to respective position sensors 20*c* and 20*d* for providing information to microcontroller 26 regarding the respective operating condition of position sensors 20*c* and 20*d*. In response, microcontroller 26 couples the most reliable sensor to summer 30 thereby providing the most accurate desired throttle angle signal ($TA_d$) to summer 30. The structure and operation of sensors 20*a–d*, their respective monitors 22*a–d*, and corresponding monitoring operations performed by microcontroller 26 are described later herein with particular reference to FIGS. 2–4.

Continuing with FIG. 1, summer 30 receives desired throttle angle signal $TA_d$ from microcontroller 26 and actual throttle angle signal $TA_a$ from selector 24 for computing throttle error signal $TA_e$. Electronic power driver 36 translates the amplitude and polarity of error signal $TA_e$ into corresponding current amplitude and phase for driving servo motor 38. In response, servo motor 38 proportionally rotates throttle plate 16 thereby reducing throttle error signal $TA_e$ such that actual throttle angle signal $TA_a$ becomes approximately equal to desired throttle angle signal $TA_d$. This operation is referred to as drive-by-wire mode of operation.

When a wheelslip control mode is also incorporated, as disclosed in the specification of U.S. Pat. No. 4,768,608, the specification of which is herein incorporated by reference, slip controller 42 provides microcontroller 26 with an indication that excessive slippage of a driven wheel has occurred such as when a slippery surface is traversed. Microcontroller 26 then reduces desired throttle angle signal $TA_d$ thereby reducing torque applied to the driven wheel and, accordingly, reducing wheel slippage. Similarly, during speed or cruise control operation, speed control controller 46 provides microcontroller 26 with information related to a desired throttle angle. Microcontroller 26 translates this information into desired throttle angle signal $TA_d$.

Figure 2:
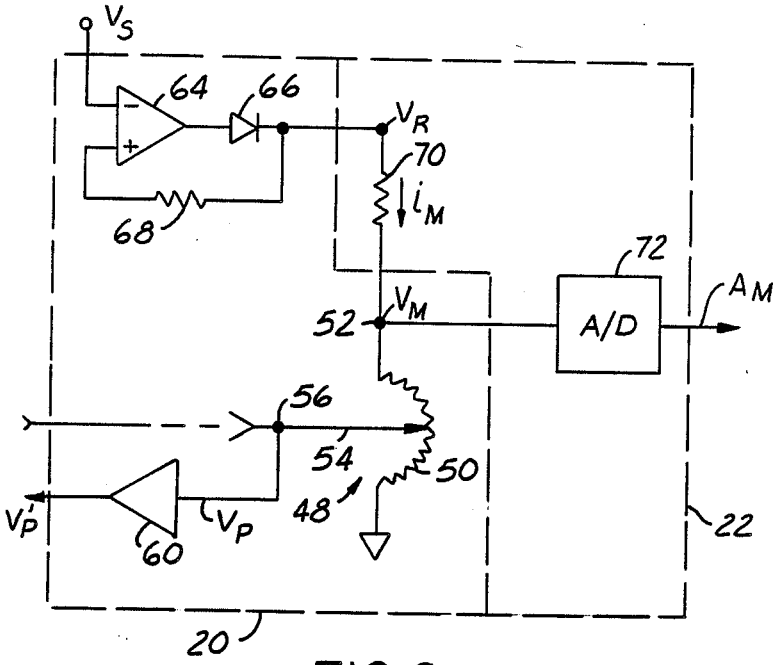
FIG. 2 is an electrical schematic of a portion of the embodiment shown in FIG. 1.
Figure 3:
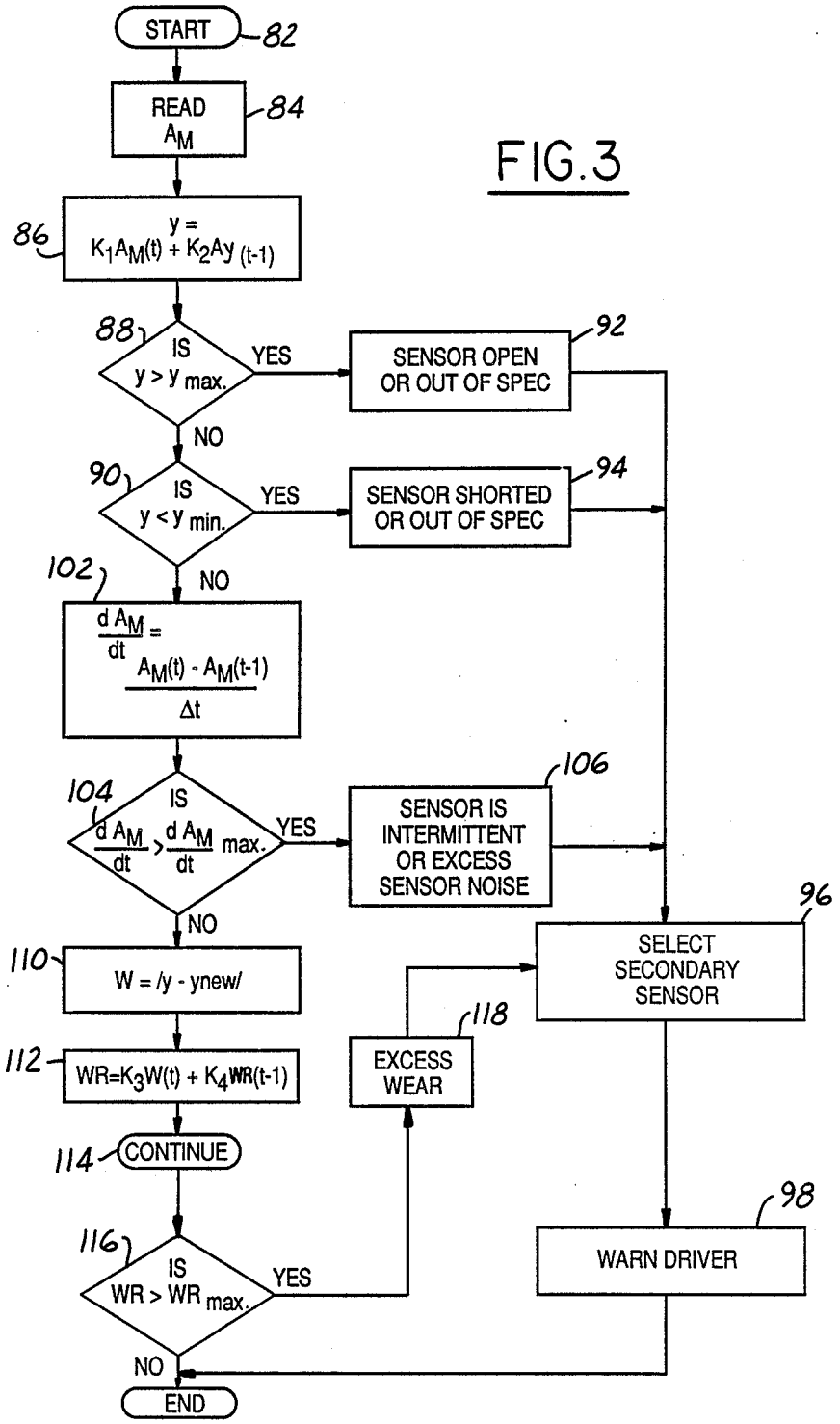
FIG. 3 illustrates various process steps performed in conjunction with the embodiment shown in FIGS. 1 and 2.

Reference is now made to FIG. 2 wherein an embodiment of position sensors 20*a–d* and monitors 22*a–d* are shown and reference is also made to FIG. 3 wherein the corresponding monitoring operations performed by microcontroller 26 are illustrated. It is noted that position sensors 20*a–d* are of identical structure as illustrated by block 20 in FIG. 2. Similarly, monitors 22*a–d* are of identical structure in the particular example illustrated by block 22 of FIG. 2. First referring to position sensor 20, potentiometer 48 is shown having main resistor 50 connected between node 52 and a conventional signal return. As described in greater detail hereinafter, the voltage at node 52 is referred to as $V_M$. Potentiometer 48 includes conventional wiper arm 54 coupled to main resistor 50. Wiper arm 54 is also mechanically coupled to a control device, such as throttle plate 16 (FIG. 1) or accelerator pedal 34 (FIG. 1). Accordingly, the voltage on wiper arm 54 at node 56 is proportional to the position of the control device coupled to wiper arm 54 and is therefore referred to as position voltage $V_P$. More specifically, position voltage $V_P$ is a portion of voltage $V_M$ as determined by the position of wiper arm 54.

Node 56 is shown coupled to high impedance buffer 60, an operational amplifier in this example. Buffer 60 provides a buffered signal $V_P'$ to selector 24 (FIG. 1) when position sensor 20 is representative of either position sensors 20*a* or 20*b*. Similarly, buffered signal $V_P'$ is coupled from buffer 60 to microcontroller 26 when position sensor 20 is representative of either position sensors 20*c* or 20*d*.

Continuing with FIG. 2, operational amplifier 64 is shown having a negative input coupled to voltage supply $V_S$ and a positive input terminal connected to a feedback loop including diode 66 and feedback resistor 68. Accordingly, the output of diode 66 is a stabilized reference voltage designated as reference voltage $V_R$.

Monitor 22, in the particular example shown in FIG. 2, includes sensing or monitoring resistor 70 and analog to digital (A/D) converter 72. Monitoring resistor 70 is shown coupled in series between reference voltage $V_R$ and node 52. Thus, voltage $V_M$ at node 52 is equal to voltage $V_R$ less the current flow ($i_M$) through resistor 70 times its resistance. Since wiper arm 54 is connected to a high impedance input at buffer 60, there is negligible current flow through wiper arm 54. Any current flow through main resistor 50 is therefore equal to current $i_M$ regardless of the position of wiper arm 54. Accordingly, any variation in the resistance of main resistor 50, such as caused by degradation, results in a change in $i_M$ and a corresponding change in voltage $V_M$. A/D convertor 72 is shown converting voltage $V_M$ to digital signal $A_M$ which is directly proportional to the actual resistance of main resistor 50.

Microcontroller 26 monitors signal $A_M$ to determine the operating condition of potentiometer 48, and main resistor 50 in particular, as now described with reference to the steps shown in FIG. 3. At the start of the monitoring sequence, one of the position sensors 20*a–d* is selected for monitoring. Signal $A_M$ is first read into memory each sample interval "t" as shown in step 84. During step 86, a digital low pass filtering of signal $A_M$ is performed by multiplying signal $A_M$ by gain constant $K_1$ and adding the resultant product to the previously stored product times gain constant $K_2$. This step is represented in equation form by:

$$y = K_1 * A_M(t) + K_2 * y\ (t-1).$$

Where $y$ = digitally filtered value of signal $A_M$ $K_1$ = gain constant $K_2$ = gain constant $A_M(t)$ = present value of signal $A_M$ $y\ (t-1)$ = previous value of signal y.

In steps 88 and 90 a determination is made whether the resistance of main resistor 50 is within its specified value. More specifically, signal y is compared to both a maximum value ($y_{max.}$) and a minimum value ($y_{min.}$) which are associated with the respective maximum and minimum resistance values of main resistor 50. For example, if the tolerance of main resistor 50 is ±5%, $y_{max.}$ is correlated with 1.05 times $R_{50}$ and $y_{min.}$ is correlated with 0.95 times $R_{50}$. In the event signal y is greater than $y_{max.}$, step 92 provides an indication that sensor 20 is either open or out of specification. If signal y is less than $y_{min.}$, step 94 provides an indication that sensor 20 either shorted or out of specification. In response, step 96 provides an instruction to select the appropriate secondary sensor. For the example presented in FIG. 1, if primary sensor 20*a* is found to be out of specification, secondary sensor 20*b* is coupled to summer 30 by operation of selector 24 in response to microcontroller 26. In the event primary sensor 20*c* is out of specification, secondary sensor 20*d* is coupled through microcontroller 26 to summer 30. In addition, if a sensor is determined to be out of specification, a warning is provided the vehicle operator as shown by step 98.

During steps 102 and 104, the derivative of signal $A_M$ is taken and compared to a maximum derivative value. More specifically, the difference in signal $A_M$ between successive sample times is computed and divided by the sample time. If this derivative exceeds the maximum value, an indication that sensor 20 is either intermittent or excessively noisy is provided by step 106. In response, the appropriate secondary position sensor is selected and the driver warned as previously described with reference to steps 96 and 98.

Steps 110, 112, 114, 116, and 118 describe a monitoring operation for determining wear of position sensor 20 during long term operation of the motor vehicle. As shown in step 110, the magnitude of the difference between y and $y_{new}$ is taken to determine wear signal W. Signal $y_{new}$ is a stored value of signal y when sensor 20 is first installed. During step 112, an additional filtering operation is performed having a substantially longer time constant then the time constant associated with step 86 which was previously described. More specifically, wear value WR is derived by multiplying wear signal W with gain constant $K_3$ during a sample period and the previously sampled wear signal WR is multiplied by gain constant $K_4$. This process continues, as shown by step 114, and the resulting wear value WR compared to a maximum wear value as shown in step 116. If wear value WR is above a desired wear value, step 118 provides an indication of excessive wear. In response, the appropriate secondary position sensor is selected and driver warned as shown by steps 96 and 98.

Figure 4:
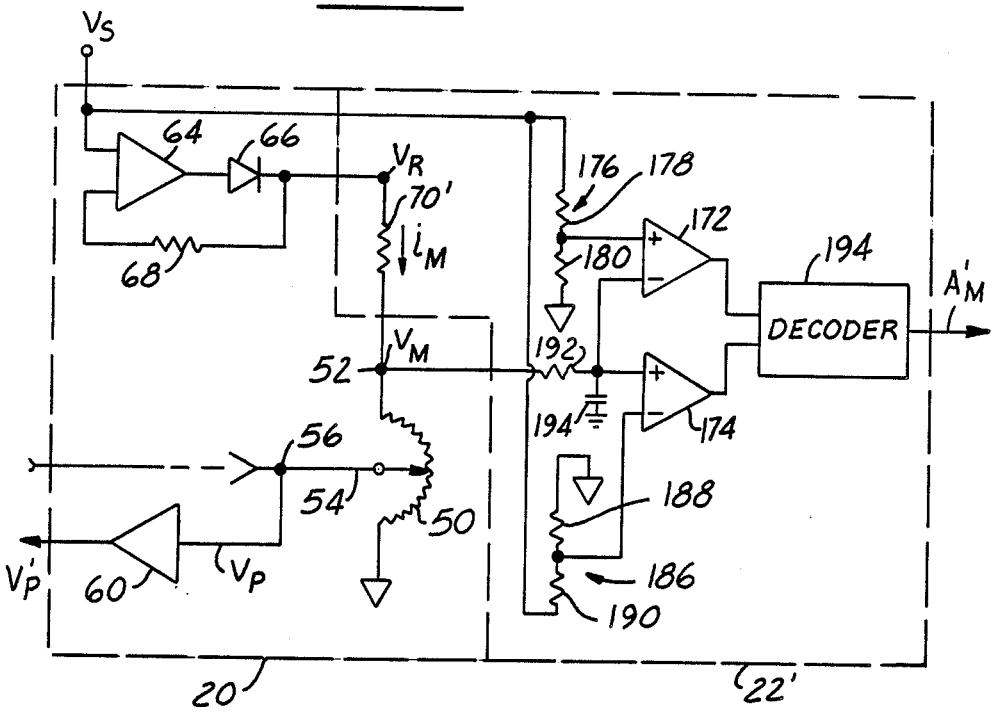
FIG. 4 is an alternate embodiment of the electrical schematic shown in FIG. 2.

An alternate embodiment for monitors $22_{c\text{-}d}$, and the monitoring operations performed by microcontroller 26, are now presented with reference to FIG. 4 wherein like numerals refer to like parts shown in FIGS. 1 and 2. Position sensors $20_{a\text{-}d}$ are shown represented by position sensor 20 and monitors $22_{a\text{-}d}$ are shown represented by monitor 22'. The structure and operation of position sensor 20 was previously described with particular reference to FIG. 2 and will therefore not be repeated.

Monitor 22' is shown including sense resistor 70' coupled in series between main resistor 50 and voltage reference $V_R$ of position sensor 20. Current flow $i_M$ through sense resistor 70 and the related voltage drop $V_M$ are inversely proportional to the actual resistance of main resistor 50 independently of wiper arm 56 position as previously described herein with particular reference to FIG. 2. Monitor 22' is also shown including operational amplifiers 172 and 174 configured as a window voltage comparator. More specifically, operational amplifier 172 is shown having a negative input terminal connected to node 52 of position sensor 20 through an R-C filter comprising resistor 192 and capacitor 194. Its positive input terminal is shown coupled to voltage divider 176 which is coupled between voltage source $V_S$ and a voltage return. Voltage divider 176 includes resistors 178 and 180 which have resistance values selected to correlate with an upper desired value of main resistor 50. Operational amplifier 174 is shown having a positive input terminal connected to node 52 of position sensor 20. The negative input terminal of operational amplifier 174 is shown coupled to voltage divider 186 having resistors 188 and 190 connected in series between voltage source $V_S$ and the voltage return. The resistance values of resistors 188 and 190 are selected to correlate with a lower desired value of main resistor 50.

Accordingly, when the resistance of main resistor 50 exceeds the upper desired value, operational amplifier 172 switches to a logic 0. Similarly, when main resistor 50 falls below the lower desired value, operational amplifier 174 switches to a logic 0. The outputs of operational amplifiers 172 and 174 are coupled to decoder 194 which provides signal $A_M'$. When main resistor 50 is beyond its specified resistance range, signal $A_M'$ provides microcontroller 26 or selector 24 with an indication that position sensor 20 is faulty and the appropriate correction action is then taken as described previously herein with particular reference to FIG. 3.

It is noted that whether either the embodiments of monitor circuit 22 (FIG. 2) or 22' (FIG. 4) are utilized, an accurate indication of the operation of position sensor 20 is provided regardless of the position of wiper arm 54. Thus, a relatively small degradation is detectable whereas prior approaches were limited to detecting catastrophic failures of the position sensor.

This concludes the Description of the Preferred Embodiment. The reading of it by those skilled in the art will bring to mind many alterations and modifications without departing from the spirit and scope of the invention. For example, the monitoring circuitry may be used to advantage with either digital processing or analog processing techniques. Accordingly, it is intended that the scope of the invention be limited only by the following claims.

What is claimed:

1. An operating condition monitoring apparatus for a position sensor coupled to a control device, comprising:

said position sensor comprising a potentiometer having a main resistor coupled between a node and an electrical return, and a wiper arm responsive to actual position of the control device and electrically coupled to said main resistor;

a sense resistor connected in series between said node and a source of electrical power; and comparison means for comparing electrical power through said sense resistor to a predetermined range to provide an indication of the operation of said main resistor independently of wiper arm position.

2. The apparatus recited in claim 1 wherein said control device comprises an operator actuable device.

3. The apparatus recited in claim 1 wherein said control device comprises an engine throttle plate.

4. An operating condition monitoring apparatus for a throttle control system in a motor vehicle, comprising:

a potentiometer for providing the throttle control system with an electrical signal related to position of a control device coupled to the throttle control system, said potentiometer including a main resistor coupled across a source of electrical power and a wiper arm responsive to actual position of said control device and electrically coupled to said main resistor for providing said electrical signal;

sensing means for sensing current flow through said main resistor thereby providing a measurement directly correlated with actual resistance of said main resistor independently of wiper arm position, said sensing means comprising a sense resistor connected in series between said main resistor and said source of electrical power; and comparison means for comparing a voltage drop across said sense resistor to a predetermined range to provide an indication of operation of said main resistor independently of wiper arm position.

5. The apparatus recited in claim 4 wherein said control device comprises an operator actuable device.

6. The apparatus recited in claim 4 wherein said control device comprises an engine throttle plate.

7. The apparatus recited in claim 4 wherein said comparison means comprises:

a first operational amplifier having a positive input terminal coupled to a first voltage reference and a negative input terminal coupled to said sense resistor;

a second operational amplifier having a negative input terminal coupled to a second voltage reference and a positive input terminal coupled to said sense resistor; and decoder means coupled to said first and second operational amplifiers for providing said indication of operation of said main resistor.

8. The apparatus recited in claim 4 further comprising an analog to digital converter coupled to said sensing means for providing said comparison means with a digital representation of said voltage drop across said sense resistor.

9. The apparatus recited in claim 8 further comprising derivative means coupled to said analog to digital converter for providing another indication of operation of said main resistor by calculating a derivative of said digital representation of said voltage drop across said sense resistor.

10. The apparatus recited in claim 8 further comprising means coupled to said analog to digital converter for providing an indication of wear in said main resistor by comparing differences between successive samples of said digital representation of said voltage drop across said sense resistor.

11. An apparatus for selecting a position sensor coupled to a control device in response to operating condition of the position sensor, comprising:

a primary position sensor coupled to the control device comprising a potentiometer having a main resistor coupled between a node and an electrical return, and a wiper arm responsive to actual position of the control device and electrically coupled to said main resistor;

a primary sense resistor connected in series between said node of said primary position sensor and a source of electrical power;

a secondary position sensor coupled to the control device comprising a potentiometer having a main resistor coupled between a node and an electrical return, and a wiper arm responsive to actual position of the control device and electrically coupled to said main resistor;

a secondary sense resistor connected in series between said node of said secondary position sensor and a source of electrical power;

comparison means for comparing a voltage drop across said primary sense resistor to a predetermined range and for comparing a voltage drop across said secondary sense resistor to a predetermined range to provide an indication of the operation of said main resistors in both said primary and said secondary position sensors independently of wiper arm position; and selection means responsive to said comparison means for selecting between said primary position sensor and said secondary position sensor.

12. The apparatus recited in claim 11 wherein said control device comprises an operator actuable device.

13. The apparatus recited in claim 11 wherein said control device comprises an engine throttle plate.

14. A throttle control system having an operating condition monitoring, comprising:

a servo motor coupled to an engine throttle plate;

a controller coupled to said servo motor responsive to an input signal related to desired throttle position and also responsive to a feedback signal related to actual throttle position;

command means for generating said input signal in response to the mechanical position of a control device, said command means including a potentiometer having a main resistor coupled to a source of electrical power and a wiper arm responsive to the mechanical position of said control device and electrically coupled to said main resistor for generating said input signal;

a sense resistor coupled between said source of electrical power and said main resistor; and comparison means for comparing electrical power through said sense resistor to a predetermined range to provide an indication of operating condition of said main resistor.

15. The apparatus recited in claim 14 wherein said comparison means comprises an analog window comparator circuit.

16. The apparatus recited in claim 14 wherein said comparison means comprises:

means for comparing a digital representation of said electrical power through said sense resistor to a digital value related to desired resistance limits of said main resistor.

17. A throttle control system having an operation condition indicator, comprising:

a servo motor coupled to an engine throttle plate;

a controller coupled to said servo motor responsive to an input signal related to desired throttle position and also responsive to a feedback signal related to actual throttle position;

feedback means for generating said feedback signal in response to the mechanical position of said engine throttle, said feedback means including a potentiometer having a main resistor coupled to a source of electrical power and a wiper arm responsive to the mechanical position of said engine throttle and electrically coupled to said main resistor for generating said feedback signal;

a sense resistor coupled between said source of electrical power and said main resistor;

conversion means for providing a digital signal related to a voltage drop across said sense resistor; and comparison means for said digital signal to a predetermined range related to desired resistance limits of said main resistor to provide an indication of operating condition of said main resistor.

18. The apparatus recited in claim 17 further comprising derivative means coupled to said conversion means for providing another indication of operation of said main resistor by calculating a derivative of said digital signal.

19. The apparatus recited in claim 17 further comprising means coupled to said conversion means for providing an indication of wear in said main resistor by comparing differences between successive samples of said digital signal.

20. A throttle control system having an operation condition indicator, comprising:

a servo motor coupled to an engine throttle plate;

a controller coupled to said servo motor responsive to an input signal related to desired throttle position and also responsive to a feedback signal related to actual throttle position;

an actuator sensor for providing said input signal in response to position of an actuator, said actuator sensor including a potentiometer coupled to said actuator having a main resistor coupled to a source of electrical power and also having a wiper arm electrically coupled to said main resistor and responsive to position of said actuator for providing said input signal;

a first sense resistor coupled between said source of electrical power and said main resistor of said actuator sensor;

a throttle sensor for providing said feedback signal in response to mechanical position of said engine throttle, said throttle sensor including a potentiometer coupled to said throttle having a main resistor coupled to a source of electrical power and also having a wiper arm responsive to mechanical position of said throttle and electrically coupled to said main resistor for providing said feedback signal;

a second sense resistor coupled between said source of electrical power and said main resistor of said throttle sensor; and comparison means for comparing a voltage drop across said first sense resistor to a predetermined range and for comparing a voltage drop across said second sense resistor to a predetermined range to provide an indication of operating condition in said main resistor of said actuator sensor and said main resistor of said throttle sensor.

21. The apparatus recited in claim 20 further comprising means coupled to said comparison means for providing a warning indication.

* * * * *